US012286808B2

(12) United States Patent
Chen

(10) Patent No.: US 12,286,808 B2
(45) Date of Patent: Apr. 29, 2025

(54) UNDERWATER CLEANING ROBOT

(71) Applicant: NingBo Poolstar Pool Products Co., Ltd, Ningbo (CN)

(72) Inventor: Liang Chen, Ningbo (CN)

(73) Assignee: NingBo Poolstar Pool Products Co., Ltd., Ningbo (CN)

( * ) Notice: Subject to any disclaimer, the term of this patent is extended or adjusted under 35 U.S.C. 154(b) by 279 days.

(21) Appl. No.: 18/173,121

(22) Filed: Feb. 23, 2023

(65) Prior Publication Data

US 2023/0193647 A1 Jun. 22, 2023

(30) Foreign Application Priority Data

Oct. 12, 2022 (CN) ..... 202211244561.7
Oct. 12, 2022 (CN) ..... 202222678510.7

(51) Int. Cl.
*E04H 4/16* (2006.01)

(52) U.S. Cl.
CPC ..... *E04H 4/1654* (2013.01); *E04H 4/16* (2013.01); *E04H 4/1636* (2013.01)

(58) Field of Classification Search
CPC ..... E04H 4/16; E04H 4/1636; E04H 4/1654
See application file for complete search history.

(56) References Cited

U.S. PATENT DOCUMENTS

2014/0101870 A1* 4/2014 Lopez ..... E04H 4/16 15/1.7
2016/0333600 A1* 11/2016 van der Meijden . A46B 13/008
2019/0161988 A1* 5/2019 Attar ..... E04H 4/1654
2022/0003016 A1* 1/2022 Sebor ..... E04H 4/1672
2022/0333394 A1* 10/2022 Tryber ..... E04H 4/1654

FOREIGN PATENT DOCUMENTS

CN 212307742 U 1/2021
CN 215502776 U 1/2022

* cited by examiner

*Primary Examiner* — Michael D Jennings

(57) ABSTRACT

An underwater cleaning robot, including a main body provided with an accommodating chamber inside, a suction motor, and a roller brush assembly. A bottom of the main body is provided with a suction port. The suction motor is arranged in the chamber, and generates suction force to draw wastes into the chamber through the suction port. The roller brush assembly includes a roller brush motor arranged in the chamber, a connecting part, and a roller brush. The connecting part is arranged on the main body and is connected to the roller brush motor. The roller brush is detachably clamped with the connecting part. The roller brush motor drives the connecting part to rotate around an axis of the roller brush motor, so as to drive the roller brush to rotate synchronously to push the waste to the suction port.

10 Claims, 6 Drawing Sheets

UNDERWATER CLEANING ROBOT

CROSS-REFERENCE TO RELATED APPLICATIONS

This application claims the benefit of priority from Chinese Patent Applications No. 202211244561.7 and No. 202222678510.7, both filed on Oct. 12, 2022. The content of the aforementioned application, including any intervening amendments thereto, is incorporated herein by reference in its entirety.

TECHNICAL FIELD

This application relates to cleaning technologies, and more particularly to an underwater cleaning robot.

BACKGROUND

Regarding the existing underwater cleaning robots, a cylindrical roller brush is generally provided at the front end. The roller brush is in contact with the ground, and can roll the surrounding waste to a suction port of the robot by rotating around its axis. However, the roller brush is fixed at the front end of the robot, with a large size and high cost, which leads to inconvenient maintenance and replacement and high maintenance costs.

SUMMARY

In view of this, an object of this application is to provide an underwater cleaning robot, whose roller brush is convenient to repair and replace, allowing for lowered repair and replace costs.

To achieve the above object, this application provides an underwater cleaning robot, comprising:

a main body;

a suction motor; and a roller brush assembly;

wherein the main body is provided with an accommodating chamber inside; a bottom of the main body is provided with a suction port; and the suction port is communicated with the accommodating chamber;

the suction motor is arranged in the accommodating chamber, and is configured to generate suction force to suck external wastes into the accommodating chamber through the suction port; and the roller brush assembly comprises a roller brush motor, a connecting part, and a roller brush; the brush assembly is arranged in the accommodating chamber; the connecting part is arranged on the main body, and partially protrudes from the bottom of the main body; the connecting part is connected to the roller brush motor; the roller brush is clamped with an end of the connecting part away from the roller brush motor, and is removable relative to the connecting part; the roller brush is provided near the suction port; the roller brush motor is configured to drive the connecting part to rotate around an axis of the roller brush motor, so as to drive the roller brush to rotate synchronously to push the external wastes to the suction port.

In an embodiment, the roller brush comprises a rotating part and a brush strip; the brush strip is provided on an outer circumference of the rotating part; and the rotating part is clamped with the connecting part, and is removable relative to the connecting part.

In an embodiment, the number of the brush strip is at least two; and at least two brush strips are arranged spaced apart on the outer circumference of the rotating part.

In an embodiment, the rotating part is provided with a first through hole; a first block and a second block are arranged at different heights of an inner wall of the first through hole; an end of the rotating part facing the connecting part is provided with a notch; an outer wall of the connecting part is provided with an annular clamping strip; the annular clamping strip is made of a plastic material; the outer wall of the connecting part is provided with a protrusion; the rotating part is configured to be sleeved on the connecting part; the protrusion is accommodated in the notch; and the annular clamping strip is configured to be clamped between the first block and the second block, so as to enable the rotating part to be clamped with the connecting part.

In an embodiment, the number of the first block is at least two; and the number of the second block is at least two.

In an embodiment, an outer diameter of the annular clamping strip decreases from middle to end.

In an embodiment, the bottom of the main body is provided with a positioning part; the positioning part is provided with a second through hole; the second through hole is communicated with the accommodating chamber; the connecting part comprises a first connecting portion and a second connecting portion connected with each other; an outer diameter of the first connecting portion is smaller than an inner diameter of the second through hole, and an outer diameter of the second connecting portion is larger than the inner diameter of the second through hole; the annular clamping strip is arranged on an outer wall of the first connecting portion; the protrusion is provided on the outer wall of the first connecting portion; a sum of the outer diameter of the first connecting portion and a height of the protrusion along a radial direction of the first connecting portion is larger than the inner diameter of the second through hole; and the positioning part is configured to be clamped between the protrusion and the second connecting part to enable connection between the connecting part and the main body.

In an embodiment, the roller brush motor is connected to a fixing part; and the fixing part is in splined connection with the connecting part, so as to enable connection between the roller brush motor and the connecting part.

In an embodiment, the main body comprises an upper housing and a lower housing; the accommodating chamber is enclosed by the upper housing and the lower housing; the suction port is located at a bottom of the lower housing; the connecting part is provided on the lower housing, and partially protrudes from the bottom of the lower housing; and the suction motor and the roller brush motor are both connected to the upper housing.

In an embodiment, the upper housing and the lower housing are removably connected through a fastener (not shown).

The beneficial effects of the present disclosure are described below.

The underwater cleaning robot is placed into a to-be-cleaned pool, and the roller brush motor and the suction motor are turned on. The roller brush motor drives the connecting part to rotate around the axis of the roller brush motor such that the connecting part drives the roller brush to rotate synchronously, so as to push the waste at the bottom of the pool to the suction port. The suction motor generates suction force to suck the waste into the chamber through the suction port, realizing the cleaning of the pool. Since the roller brush is detachably clamped with the connecting part, the roller brush can be directly removed from the connecting part when it needs to be repaired or replaced, simplifying the maintenance and replacement operation.

BRIEF DESCRIPTION OF THE DRAWINGS

In order to more clearly describe the technical solutions in the embodiments of the present application or the prior art, drawings that need to be used in the description of the embodiments or the prior art will be briefly introduced below. Obviously, presented in the drawings are only some embodiments of the present disclosure. For one of ordinary skill in the art, other drawings can be obtained according to the drawings provided herein without paying creative effort.

Figure 1:
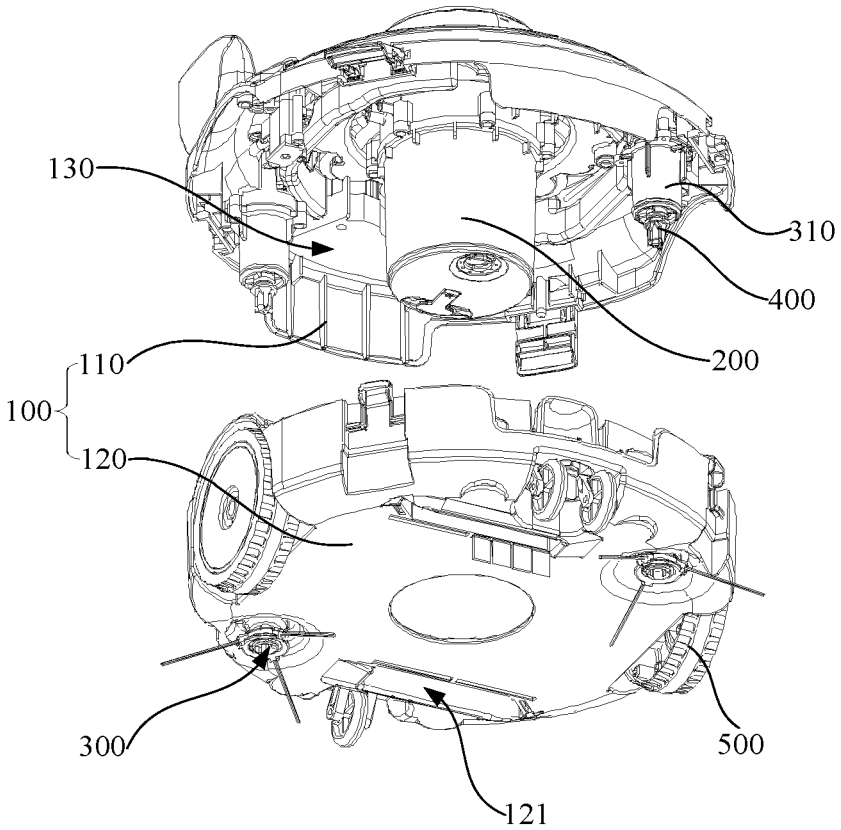
FIG. 1 is a schematic diagram of an underwater cleaning robot according to an embodiment of this disclosure.

In the drawings, 100, main body; 110, upper housing; 120, lower housing; 121, suction port; 130, accommodating chamber; 140, positioning part; 141, second through hole; 142, second notch; 150, first barrel structure; 160, second barrel structure; 200, suction motor; 300, roller brush assembly; 310, roller brush motor; 320, connecting part; 321, first connecting portion; 3211, annular clamping strip; 3212, protrusion; 322, second connecting portion; 323, inner spline; 330, roller brush; 331, rotating part; 3311, mounting slot; 3312, first through hole; 3313, first block; 3314, second block; 3315, first notch; 332, brush strip; 400, fixing part; 410, outer spline; and 500, rotating wheel.

The technical solutions, functional characteristics, and advantages of this application will be further described below with reference to the embodiments and drawings.

DETAILED DESCRIPTION OF EMBODIMENTS

The technical solutions of the present application will be clearly and completely described below with reference to the drawings and embodiments of this application. Obviously, described below are only some embodiments of the present application, which are not intended to limit the present application. Based on the embodiments provided herein, other embodiments obtained by one of ordinary skill in the art without paying any creative effort shall fall within the scope of this application.

It should be noted that as used herein, all directional terms (such as up, down, left, right, front, rear, etc.) are only used to explain the relative position relationship and movement situation between components in a particular posture (as shown in the drawings). If the particular posture changes, the directional indication will change accordingly. In addition, the terms "first", "second", etc. in this application are only descriptive and can not be understood as indicating or implying relative importance or the number of technical features referred to. Therefore, the features defined with "first" and "second" may explicitly or implicitly include at least one of the features. In addition, as used herein, the "and/or" includes three solutions, for example, the "A and/or B" includes A, B, and a combination of A and B. In addition, the technical solutions of various embodiments can be combined as long as the combined technical solution can be implemented by those skilled in the art. When the combination of technical solutions is contradictory or cannot be implemented, it should be considered that such combination of technical solutions does not exist, and does not fall into the scope of this application defined by the appended claims.

Figure 2:
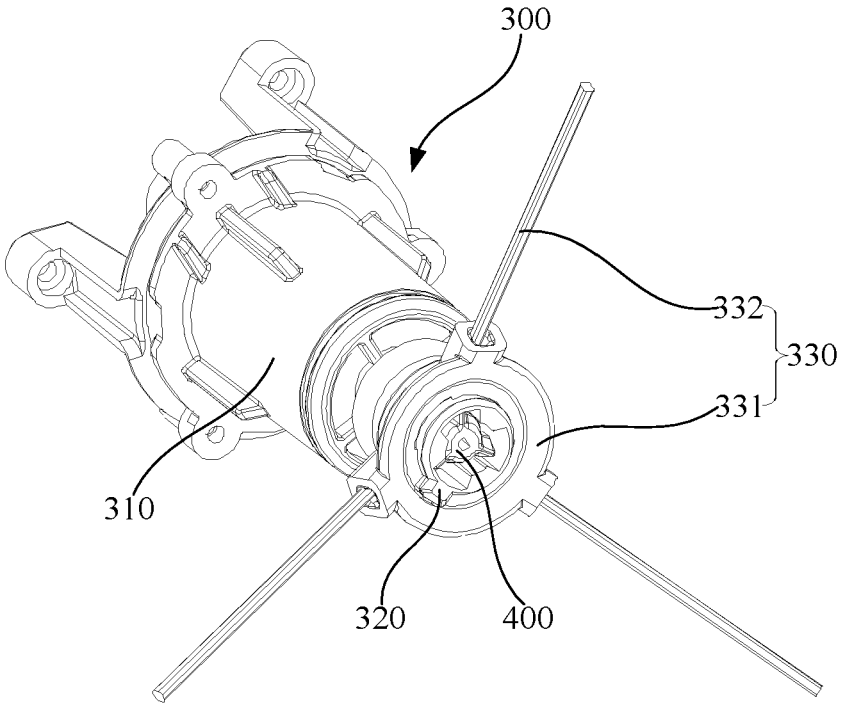
FIG. 2 is a schematic diagram of a roller brush assembly according to an embodiment of this disclosure.

As shown in FIGS. 1 and 2, an embodiment of the disclosure provides an underwater cleaning robot, including a main body 100, a suction motor 200, and a roller brush assembly 300. The main body 100 is provided with an accommodating chamber 130, and a bottom of the main body 100 is provided with a suction port 121. The suction port 121 is communicated with the accommodating chamber 130. The suction motor 200 is arranged in the accommodating chamber 130. The suction motor 200 is configured to generate suction force to suck external waste into the accommodating chamber 130 through the suction port 121. The roller brush assembly 300 includes a roller brush motor 310, a connecting part 320, and a roller brush 330. The brush assembly 300 is arranged in the accommodating chamber 130. The connecting part 320 is arranged on the main body 100 and partially protrudes from the bottom of the main body 100. The connecting part 320 is connected to the roller brush motor 310. The roller brush 330 is clamped with an end of the connecting part 320 away from the roller brush motor 310 and is removable relative to the connecting part 320. The roller brush 330 is provided near the suction port 121. The roller brush motor 310 is configured to drive the connecting part 320 to rotate around an axis of the roller brush motor 310, so as to drive the roller brush 330 to rotate synchronously to push the external waste to the suction port 121.

The underwater cleaning robot is placed into a to-be-cleaned pool, and the roller brush motor 310 and the suction motor 200 are turned on. The roller brush motor 310 drives the connecting part 320 to rotate around the axis of the roller brush motor 310, so as to drive the roller brush 330 to rotate synchronously to push the waste at the bottom of the pool to the suction port 121. The suction motor 200 generates suction force to suck the waste into the accommodating chamber 130 through the suction port 121, thus realizing the cleaning of the waste in the pool. Since the roller brush 330 is clamped with the connecting part 320 and is removable relative to the connecting part 320, the roller brush 330 can be directly pulled off from the connecting part 320 when the roller brush 330 needs to be maintained or replaced, simplifying the maintenance and replacement of the roller brush 330.

In this embodiment, both the suction motor 200 and the roller brush motor 310 are treated with water resistance.

Further, referring to FIG. 2, the roller brush 330 includes a rotating part 331 and a brush strip 332. The brush strip 332 is provided on an outer circumference of the rotating part 331. The rotating part 331 is clamped with the connecting part 320 and is removable relative to the connecting part 320. Specifically, the roller brush motor 310 drives the connecting part 320 and the rotating part 331 to rotate around the axis of the roller brush motor 310, so as to drive the brush strip 332 to rotate to pushes the waste at the bottom of the pool to the suction port 121.

Figure 3:
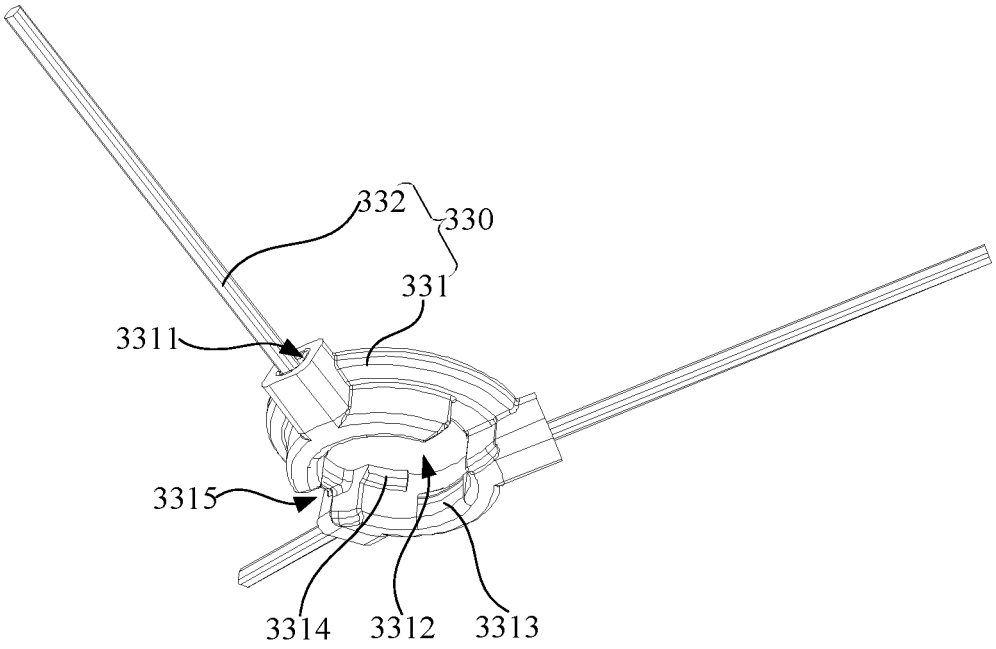
FIG. 3 is a schematic diagram of a roller brush according to an embodiment of this disclosure.

Further, referring to FIG. 3, a mounting slot 3311 is provided in a side wall of the rotating part 331, and the brush strip 332 is partially accommodated in the mounting slot 3311.

Further, referring to FIG. 3, the number of the brush strip 332 is at least two, and the at least two brush strips 332 are arranged spaced apart on the outer circumference of the rotating part 331. Specifically, a plurality of brush strips 332 rotate around the axis of the roller brush motor 310 at the same time such that the external waste can be driven to the surroundings of the suction port 121 more reliably. Further, the number of the mounting slot 3311 is the same as that of the brush strip 332, and the mounting slots 3311 are in one-to-one correspondence to the brush strips 332. In this embodiment, the number of the brush strip 332 is three.

Further, the brush strip 332 is made of plastic.

Figure 4:
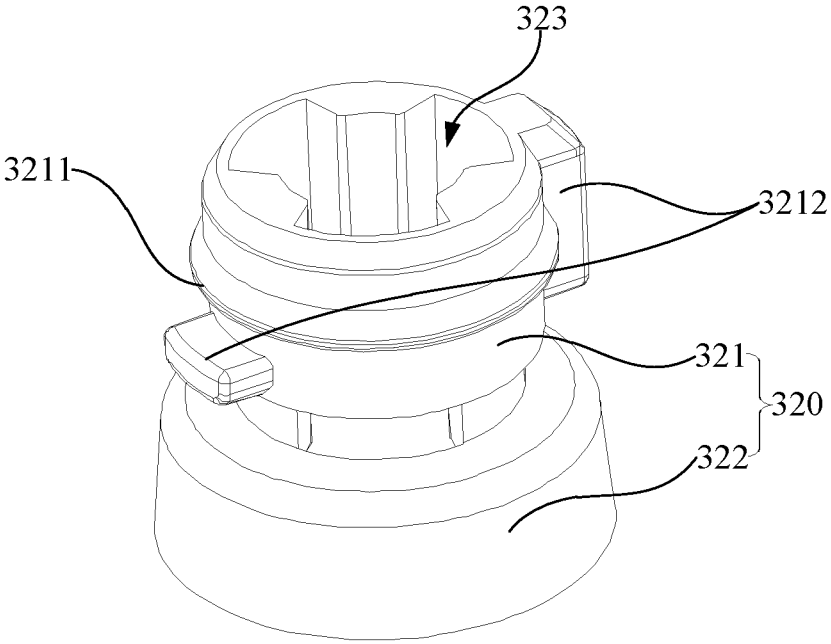
FIG. 4 is a schematic diagram of a connecting part according to an embodiment of this disclosure.
Figure 5:
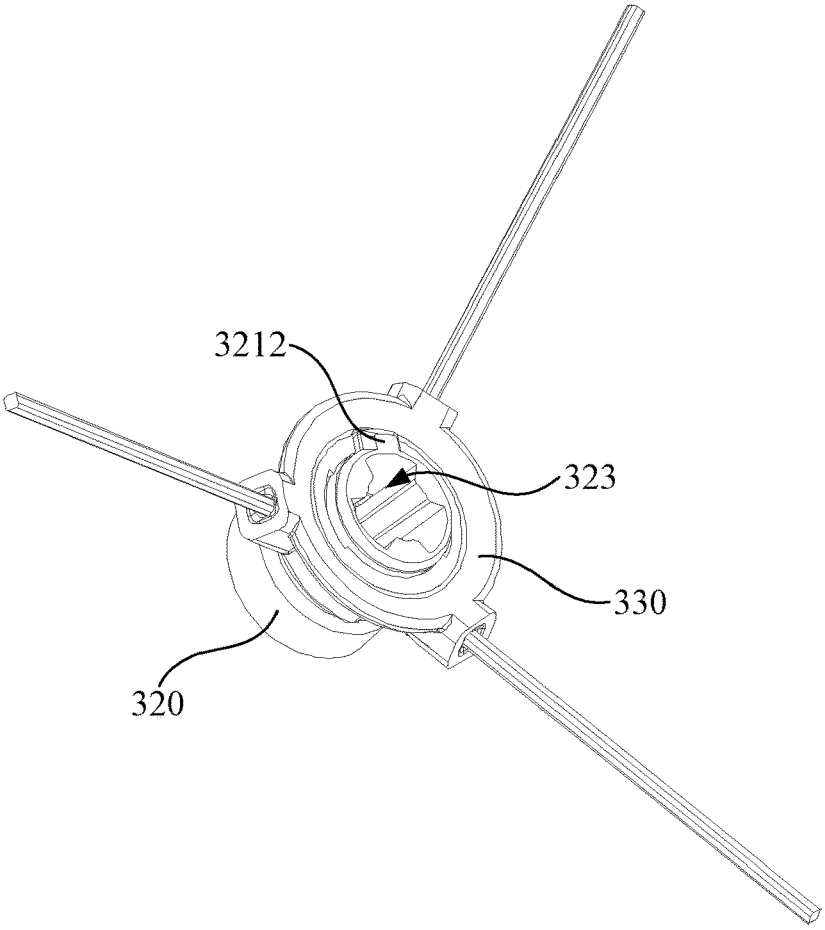
FIG. 5 schematically shows assembly of the roller brush and the connecting part according to an embodiment of this disclosure.
Figure 6:
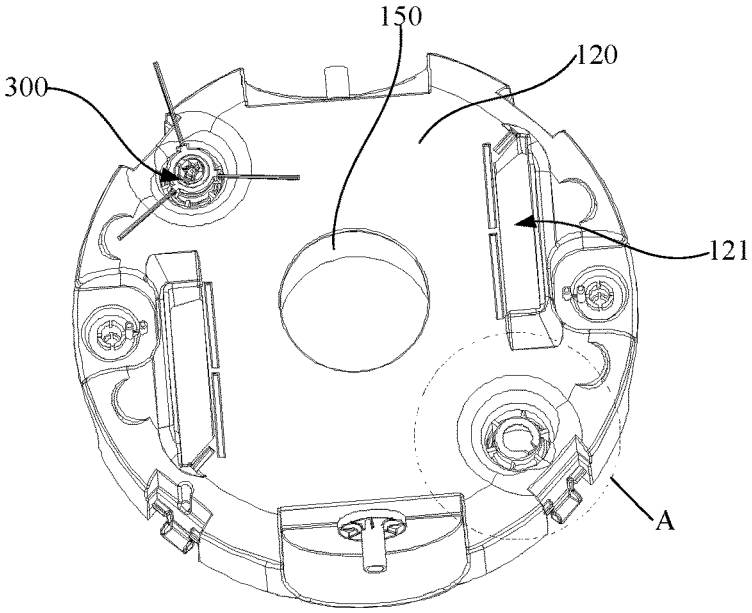
FIG. 6 schematically shows assembly of a lower housing and the roller brush assembly according to an embodiment of this disclosure in one perspective.

Further, referring to FIGS. 3-5, the rotating part 331 is provided with a first through hole 3312. A first block 3313 and a second block 3314 are arranged at different heights of an inner wall of the first through hole 3312. An end of the rotating part 331 facing the connecting part 320 is provided with a first notch 3315. An outer wall of the connecting part 320 is provided with an annular clamping strip 3211. The annular clamping strip 3211 is made of plastic material. The outer wall of the connecting part 320 is also provided with a protrusion 3212. The rotating part 331 is configured to be sleeved on the connecting part 320. The protrusion 3212 is accommodated in the first notch 3315 such that the annular clamping strip 3211 can be held between the first block 3313 and the second block 3314, so as to enable the rotating part 331 to be clamped with the connecting part 320.

Specifically, the protrusion 3212 of the connecting part 320 is arranged in the first notch 3315 of the rotating part 331 to avoid rotation of the rotating part 331 relative to the connecting part 320, so that the connecting part 320 can drive the rotating part 331 to rotate simultaneously. The annular clamping strip 3211 of the connecting part 320 can be held between the first block 3313 and the second block 3314 of the rotating part 331, so that the movement of the rotating part 331 relative to the connecting part 320 in an axial direction is limited, ensuring that the rotating part 331 does not get off the connecting part 320. Furthermore, since the annular clamping strip 3211 is made of plastic material, when the roller brush 330 needs to be removed, a large external force is used to pull the rotating part 331 to deform the annular clamping strip 3211, resulting in that the rotating part 331 can be pulled from the connecting part 320. Conversely, when the roller brush 330 needs to be installed, the rotating part 331 is aligned with the connecting part 320 and then pressed with a large force to deform the annular clamping strip 3211 such that the first block 3313 crosses the annular clamping strip 3211 while the second block 3314 fails to cross the annular clamping strip 3211. In this way, the annular clamping strip 3211 can be held between the first block 3313 and the second block 3314, thereby enabling the installation of the rotating part 331 relative to the connecting part 320.

Further, referring to FIG. 3, the number of the first block 3313 is at least two, and the number of the second block 3314 is at least two. At least two first blocks 3313 are arranged spaced apart at the same height of the inner wall of the first through hole 3312. At least two second blocks 3314 are arranged spaced apart at the same height of the inner wall of the first through hole 3312. Specifically, the annular clamping strip 3211 is held between the at least two first blocks 3313 and the at least two second blocks 3314 to enable the annular clamping strip 3211 to be held more reliably relative to the first blocks 3313 and the second blocks 3314. In this way, the fixing of the rotating part 331 relative to the connecting part 320 in the axial direction is more reliably, thus ensuring that the rotating part 331 does not get off the connecting part 320.

Further, referring to FIG. 4, two protrusions 3212 opposite to each other are arranged on the outer side wall of the connecting part 320. Two first notches 3315 opposite to each other are provided on the rotating part 331. The protrusions 3212 are in one-to-one correspondence to the first notches 3315, and the two protrusions 3212 are respectively accommodated in the corresponding first notch 3315. In this way, the rotating part 331 can be more reliably prevented from rotating relative to the connecting part 320, thereby ensuring that the connecting part 320 can drive the rotating part 331 to rotate simultaneously.

Further, referring to FIG. 4, the outer diameter of the annular clamping strip 3211 decreases from the middle to the ends. Therefore, it is easy to clamp the annular clamping strip 3211 between the first block 3313 and the second block 3314 when the roller brush 330 needs to be removed or installed.

Further, referring to FIGS. 4 and 6-9, the bottom of the main body 100 is provided with a positioning part 140. The positioning part 140 is provided with a second through hole 141. The second through hole 141 is communicated with the accommodating chamber. The connecting part 320 includes a first connecting portion 321 and a second connecting portion 322 connected with each other. The outer diameter of the first connecting portion 321 is smaller than an inner diameter of the second through hole 141, and the outer diameter of the second connecting portion 322 is larger than the inner diameter of the second through hole 141. The annular clamping strip 3211 is arranged on the outer wall of the first connecting portion 321. The protrusion 3212 is provided on the outer wall of the first connecting portion 321, and a sum of the outer diameter of the first connecting portion 321 and a height of the protrusion 3212 along the radial direction of the first connecting portion 321 is larger than the inner diameter of the second through hole 141. The positioning part 140 is configured to be clamped between the protrusion 3212 and the second connecting part 322, thereby enabling connection between the connecting part 320 and the main body 100.

Figure 7:
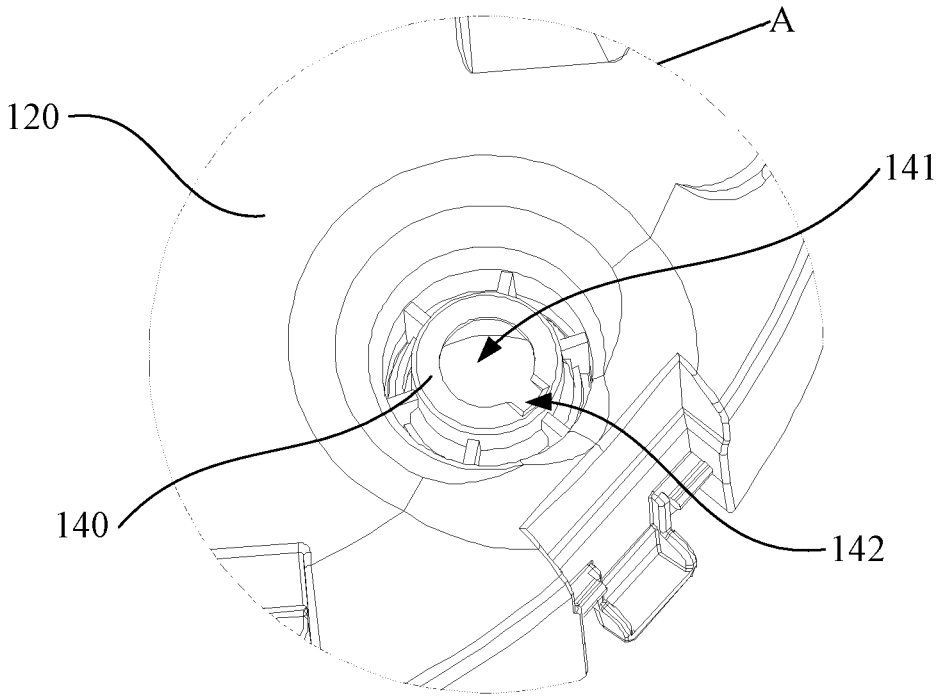
FIG. 7 is an enlarged view of part A in FIG. 6.
Figure 8:
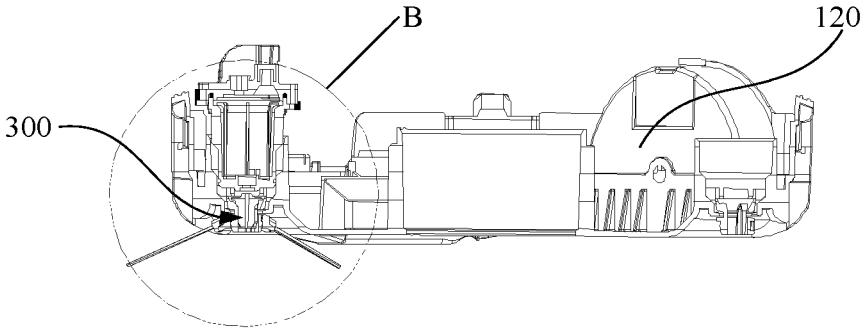
FIG. 8 is a cross-sectional view illustrating the assembly of the lower housing and the roller brush assembly according to an embodiment of this disclosure.
Figure 9:
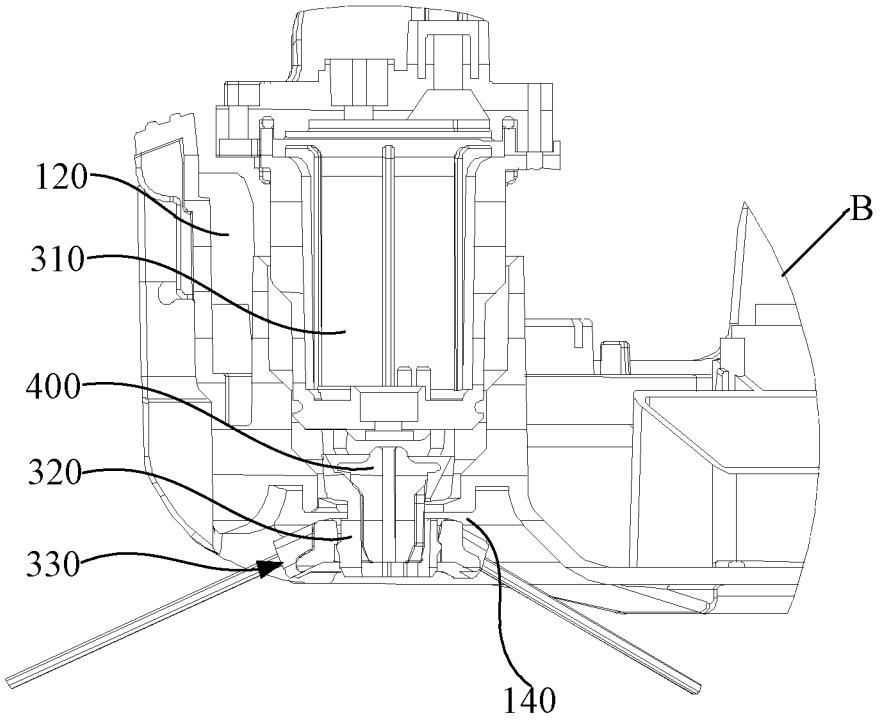
FIG. 9 is an enlarged view of part B in FIG. 8.

Further, referring to FIG. 4 and FIG. 7, the positioning part 140 is provided with a second notch 142. The second notch 142 is communicated with the second through hole 141. The second notch 142 matches with the protrusion 3212 of the connecting part 320. Specifically, after the roller brush 330 (or the rotating part 331) is removed from the connecting part 320, the connecting part 320 is rotated such that the protrusion 3212 of the connecting part 320 is aligned with the second notch 142. After that, the connecting part 320 is pressed to enable the connecting part 320 to be removed from the positioning part 140. When the connecting part 320 has two protrusions 3212, the connecting part 320 is rotated to enable one of the two protrusions 3212 of the connecting part 320 to be aligned with the second notch 142. Then the connecting part 320 is pressed to enable a first protrusion 3212 to pass through the second notch 142, and then continue to rotate the connecting part 320 to enable a second protrusion 3212 to be aligned with the second notch 142. Afterwards, the connecting part 320 is pressed to allow the second protrusion 3212 to pass through the second notch 142, thus enabling the connecting part 320 to be removed from the positioning part 140. In this way, the maintenance and replacement of the connecting part 320 are convenient. When the connecting part 320 is damaged, only the connecting part 320 needs to be replaced.

Further, referring to FIG. 1, the number of the roller brush assembly 300 is at least two, and the at least two roller brush assemblies 300 can push the external waste near the suction port 121 more reliably. In this embodiment, the number of the positioning part 140 is the same as that of the roller brush assembly 300, and the positioning parts 140 are in one-to-one correspondence to the roller brush assemblies 300. The number of the suction port 121 is also the same as that of the roller brush assembly 300, and the suction ports 121 are in one-to-one correspondence to the brush roller assemblies 300.

Figure 10:
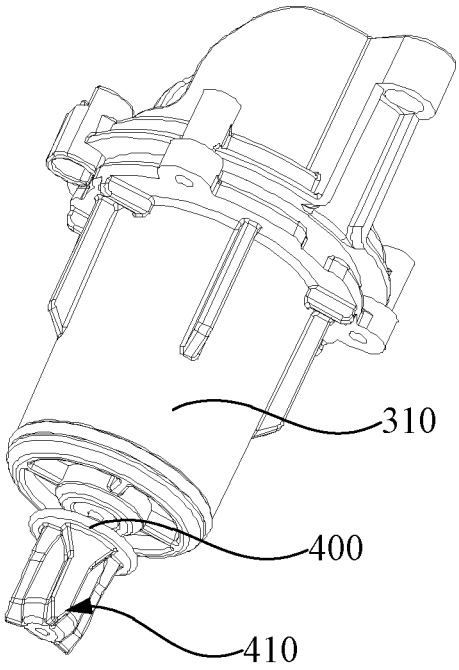
FIG. 10 schematically shows assembly of a roller brush motor and a fixing part according to an embodiment of this disclosure.

Further, referring to FIGS. 1 and 10, the roller brush motor 310 is connected to a fixing part 400, which is in splined connection with the connecting part 320. By this arrangement, the roller brush motor 310 can be connected to the connecting part 320.

Further, referring to FIGS. 2, 4 and 10, the fixing part 400 is provided with an outer spline 410, and the connecting part 320 is provided with an inner spline 323. The outer spline 410 matches with the inner spline 323, and is accommodated within the inner spline 323 to achieve a splined connection between the fixing part 400 and the connecting part 320.

Further, referring to FIG. 1, the main body 100 includes an upper housing 110 and a lower housing 120. The accommodating chamber 130 is enclosed by the upper housing 110 and the lower housing 120. The suction port 121 is located at the bottom of the lower housing 120. The connecting part 320 is provided on the lower housing 120 and partially protrudes from the bottom of the lower housing 120. The suction motor 200 and the roller brush motor 310 are both connected to the upper housing 110. Specifically, when the upper housing 110 is disassembled, the upper housing 110 can drive the suction motor 200 and the roller brush motor 310 to be removed together.

Further, the upper housing 110 and the lower housing 120 are removably connected through buckles. Specifically, the upper housing 110 and the lower housing 120 are connected through buckles, resulting in an easy disassembly, and thus facilitating inspection and maintenance of components within the main body 100.

Figure 11:
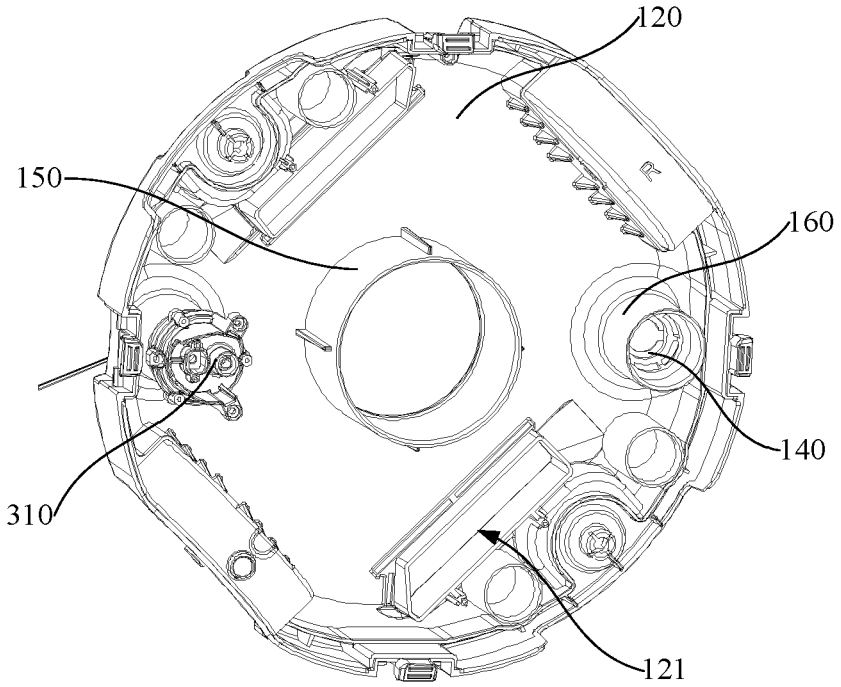
FIG. 11 schematically illustrates the assembly of the lower housing and the roller brush assembly according to an embodiment of this disclosure from another perspective.

Further, referring to FIGS. 1 and 11, the lower housing 120 is specifically recessed towards the upper housing 110 to form a first barrel structure 150 with open ends. The first barrel structure 150 is configured to accommodate the suction motor 200. Specifically, when the upper housing 110 and the lower housing 120 are buckled together, the suction motor 200 connected to the first housing 110 is accommodated within the first barrel structure 150.

Further, referring to FIGS. 1 and 11, the lower housing 120 is specifically recessed towards the upper housing 110 to form a second barrel structure 160 with open ends. The second barrel structure 160 is configured to accommodate the roller brush motor 310. Specifically, when the upper housing 110 and the lower housing 120 are buckled together, the suction motor 310 connected to the upper housing 110 is accommodated within the second barrel structure 160. In this embodiment, the number of the second barrel structure 160 is the same as the number of the brush roll assembly 300, and the second barrel structures 160 are in one-to-one correspondence to the brush roll motors 310.

Further, a filter screen is provided between the upper housing 110 and the lower housing 120, and a water outlet is provided on the upper housing 110. Specifically, under the suction action of the suction motor 200, the external waste is sucked into the chamber 130 through the suction port 121 and then filtered through the filter screen. Subsequently, the filtered liquid is discharged through the water outlet, while the waste blocked by the filter screen remains in the chamber between the lower housing 120 and the filter screen.

Further, referring to FIG. 1, the bottom of the main body 100 is provided with a rotating wheel 500, which can drive the main body 100 to move to facilitate cleaning at different areas by the underwater cleaning robot. Specifically, in this embodiment, the filtered liquid is discharged through the water outlet, which generates a force in the opposite direction to the water outlet. The force then drives the rotating wheel 500 to rotate such that the main body 100 is driven to move in the opposite direction to the discharging direction of the filtered liquid. In this embodiment, the rotating wheel 500 is located at the bottom of the lower housing 120.

Further, referring to FIG. 1, the number of the rotating wheel 500 is two, and the two rotating wheels 500 are spaced apart at the bottom of the second housing 120.

Described above are only preferred embodiments of this application, which are not intended to limit the scope of this application. It should be understood that any changes, modifications and replacements made by those skilled in the art without departing from the spirit of the present disclosure should fall within the scope of the present disclosure defined by the appended claims.

What is claimed is:

1. An underwater cleaning robot, comprising:

a main body;

a suction motor; and a roller brush assembly;

wherein the main body is provided with an accommodating chamber inside; a bottom of the main body is provided with a suction port; and the suction port is communicated with the accommodating chamber;

the suction motor is arranged in the accommodating chamber, and is configured to generate suction force to suck external wastes into the accommodating chamber through the suction port; and the roller brush assembly comprises a roller brush motor, a connecting part, and a roller brush; the brush assembly is arranged in the accommodating chamber; the connecting part is arranged on the main body, and partially protrudes from the bottom of the main body; the connecting part is connected to the roller brush motor; the roller brush is clamped with an end of the connecting part away from the roller brush motor, and is removable relative to the connecting part; the roller brush is provided near the suction port; the roller brush motor is configured to drive the connecting part to rotate around an axis of the roller brush motor, so as to drive the roller brush to rotate synchronously to push the external wastes to the suction port.

2. The underwater cleaning robot of claim 1, wherein the roller brush comprises a rotating part and a brush strip; the brush strip is provided on an outer circumference of the rotating part; and the rotating part is clamped with the connecting part, and is removable relative to the connecting part.

3. The underwater cleaning robot of claim 2, further comprising at least two brush strips; and the at least two brush strips being arranged spaced apart on the outer circumference of the rotating part.

4. The underwater cleaning robot of claim 2, wherein the rotating part is provided with a first through hole; a first block and a second block are arranged at different heights of an inner wall of the first through hole; an end of the rotating part facing the connecting part is provided with a notch; an outer wall of the connecting part is provided with an annular clamping strip; the annular clamping strip is made of a plastic material; the outer wall of the connecting part is provided with a protrusion; the rotating part is configured to be sleeved on the connecting part; the protrusion is accommodated in the notch; and the annular clamping strip is configured to be clamped between the first block and the second block, so as to enable the rotating part to be clamped with the connecting part.

5. The underwater cleaning robot of claim 4, further comprising at least two first blocks and at least two second blocks.

6. The underwater cleaning robot of claim 4, wherein an outer diameter of the annular clamping strip decreases from middle to end.

7. The underwater cleaning robot of claim 4, wherein the bottom of the main body is provided with a positioning part; the positioning part is provided with a second through hole; the second through hole is communicated with the accommodating chamber; the connecting part comprises a first connecting portion and a second connecting portion connected with each other; an outer diameter of the first connecting portion is smaller than an inner diameter of the second through hole, and an outer diameter of the second connecting portion is larger than the inner diameter of the second through hole; the annular clamping strip is arranged on an outer wall of the first connecting portion; the protrusion is provided on the outer wall of the first connecting portion; a sum of the outer diameter of the first connecting portion and a height of the protrusion along a radial direction of the first connecting portion is larger than the inner diameter of the second through hole; and the positioning part is configured to be clamped between the protrusion and the second connecting part to enable connection between the connecting part and the main body.

8. The underwater cleaning robot of claim 1, wherein the roller brush motor is connected to a fixing part; and the fixing part is in splined connection with the connecting part, so as to enable connection between the roller brush motor and the connecting part.

9. The underwater cleaning robot of claim 1, wherein the main body comprises an upper housing and a lower housing; the accommodating chamber is enclosed by the upper housing and the lower housing; the suction port is located at a bottom of the lower housing; the connecting part is provided on the lower housing, and partially protrudes from the bottom of the lower housing; and the suction motor and the roller brush motor are both connected to the upper housing.

10. The underwater cleaning robot of claim 9, wherein the upper housing and the lower housing are removably connected through a fastener.

* * * * *